US006542709B1

(12) United States Patent
Wang et al.

(10) Patent No.: US 6,542,709 B1
(45) Date of Patent: Apr. 1, 2003

(54) DEVELOPER CONTAINER WITH COMMONLY DRIVEN MIXER AND TONER SUPPLY

(75) Inventors: Jui-Chi Wang, Taichung (TW); Robin Hsu, Taichung (TW); Ching Yu Huang, Taichung (TW); Li Kuan Tung, Taichung (TW)

(73) Assignee: General Plastic Industrial Co., Ltd., Taichung (TW)

( * ) Notice: Subject to any disclaimer, the term of this patent is extended or adjusted under 35 U.S.C. 154(b) by 0 days.

(21) Appl. No.: 09/969,045

(22) Filed: Oct. 1, 2001

(51) Int. Cl.[7] ..... G03G 15/08
(52) U.S. Cl. ..... 399/263
(58) Field of Search ..... 399/258, 262, 399/263

(56) References Cited

U.S. PATENT DOCUMENTS 5,331,381 A * 7/1994 Ota et al. ..... 399/258
5,970,293 A * 10/1999 Huang ..... 399/262
6,091,920 A * 7/2000 Kita et al. ..... 399/262
6,128,453 A * 10/2000 Ban et al. ..... 399/263 X
6,229,976 B1 * 5/2001 Kimura ..... 399/262

* cited by examiner

*Primary Examiner*—Fred L Braun
(74) *Attorney, Agent, or Firm*—Pro-Techtor International Services

(57) ABSTRACT

A developer container having a gear transmission mechanism coupled between a mixer, which is mounted inside the container body of the developer container to mix developer, and a propelling screw, which is mounted in a developer supply trough at a bottom side of the developer container and adapted to propel developer out of the developer container and the developer supply trough, for enabling the mixer to be rotated to mix developer upon rotary motion of the propelling screw to propel developer out of the developer supply trough.

6 Claims, 6 Drawing Sheets

DEVELOPER CONTAINER WITH COMMONLY DRIVEN MIXER AND TONER SUPPLY

BACKGROUND OF THE INVENTION

The present invention relates to a developer container for use in a copy machine or the like and, more particularly to such a developer container, which uses a gear transmission mechanism to couple a mixer to a propel screw so that developer is mixed when propelled out of the developer container into the copy machine.

FIG. 1 shows a developer container constructed according to U.S. Pat. No. 6,049,685. According to this design, the developer container comprises a container body A, a mixer B revolvably supported in the container body A and adapted to mix developer, a connector B1 fixedly fastened to one end of the mixer B outside the container body A, a developer output port D, a propelling screw C revolvably supported in the container body A and adapted to propel developer out of the container body A through the developer output port D, and a second connector C1 fixedly fastened to one end of the propelling screw C outside the container body A. When inserted into the copy machine, the first connector B1 and the second connector C1 are respectively coupled to two separate transmission mechanisms in the copy machine, i.e., the copy machine to be used with the developer container must have two transmission mechanisms for rotating the mixer B and the propelling screw C respectively. FIG. 2 shows another design of developer container constructed according to U.S. Pat. No. 6,128,453. This structure of developer container comprises a container body E, the container body E having an axially extended developer guide groove F and a developer output port F1 at one end of the developer guide groove F, a propelling screw G supported in the developer guide groove F and adapted to propel developer out of the developer guide groove F through the developer output port F1, and an end cap H sealing the developer output port F1. Before inserting the developer container into the copy machine, the end cap H must be removed with force. Further, because this structure of developer container has no means to mix developer, laminar flow of developer tends to occur, affecting copying quality.

SUMMARY OF THE INVENTION

The present invention has been accomplished to provide a developer container, which eliminates the aforesaid drawbacks. It is one object of the present invention to provide a developer container, which automatically mixes developer when driven to propel developer into the copy machine. It is another object of the present invention to provide a developer container, which enables the copy machine to drive the developer mixer and the developer propelling screw through one single driving mechanism. According to one aspect of the present invention, the developer container comprises an elongated container body holding a developer, a developer supply trough integral with the container body and adapted to guide developer out of the container body, a mixer mounted in the developer container and adapted to mix the developer, a propelling screw mounted in the developer supply trough for connection to the driving mechanism of a copy machine for free rotation to propel the developer out of the developer supply trough, and a transmission mechanism coupled between the propelling screw and the mixer for enabling the mixer to be rotated to mix the developer in the container body upon rotary motion of the propelling screw.

According to another aspect of the present invention, the transmission mechanism comprises a driving gear fixedly fastened to one end of the propelling screw, a driven gear fixedly fastened to one end of the mixer, and a transmission gear meshed between the driving gear and the driven gear. According to still another aspect of the present invention, a slide is coupled to the developer supply trough and moved axially along the developer supply trough to close/open a developer output port in an end cap at one end of the developer supply trough.

DETAILED DESCRIPTION OF THE PREFERRED EMBODIMENT

Figure 1:
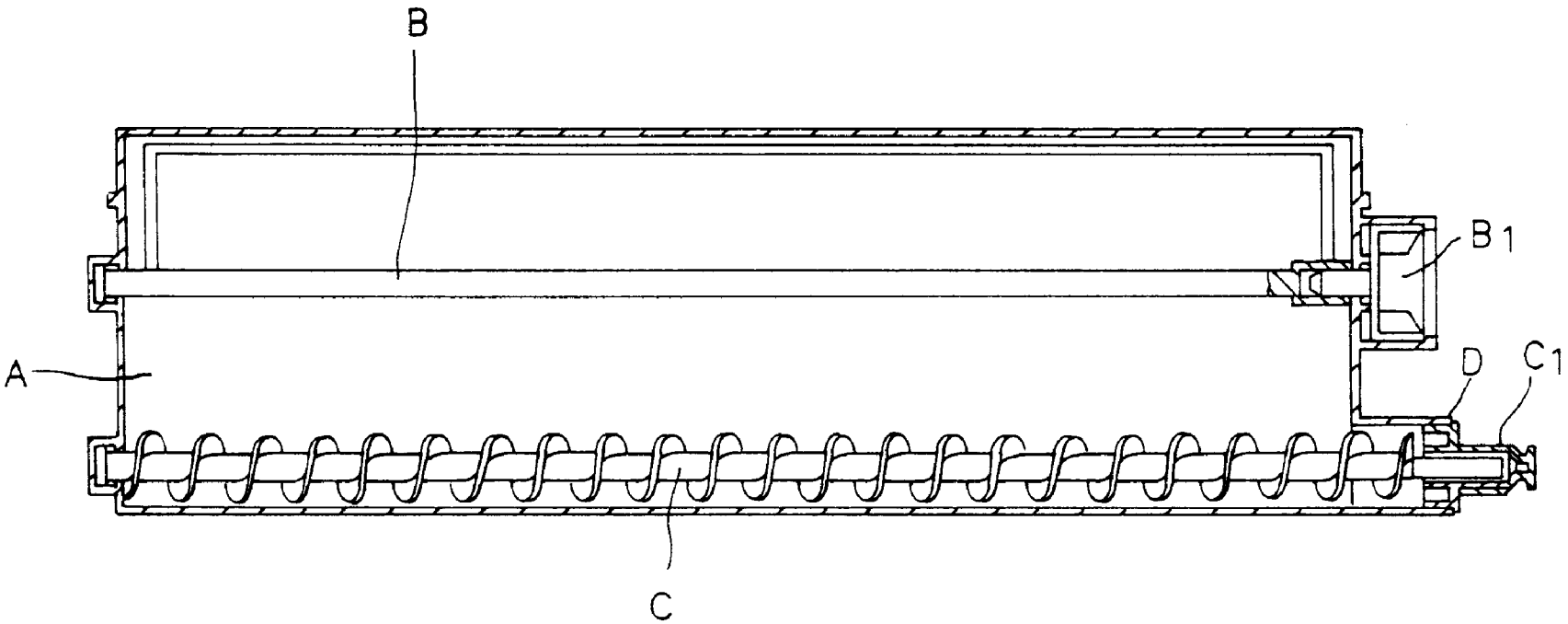
FIG. 1 (PRIOR ART)
FIG. 1 is a side view in section of a developer container according to U.S. Pat. No. 6,049,685.
Figure 2:
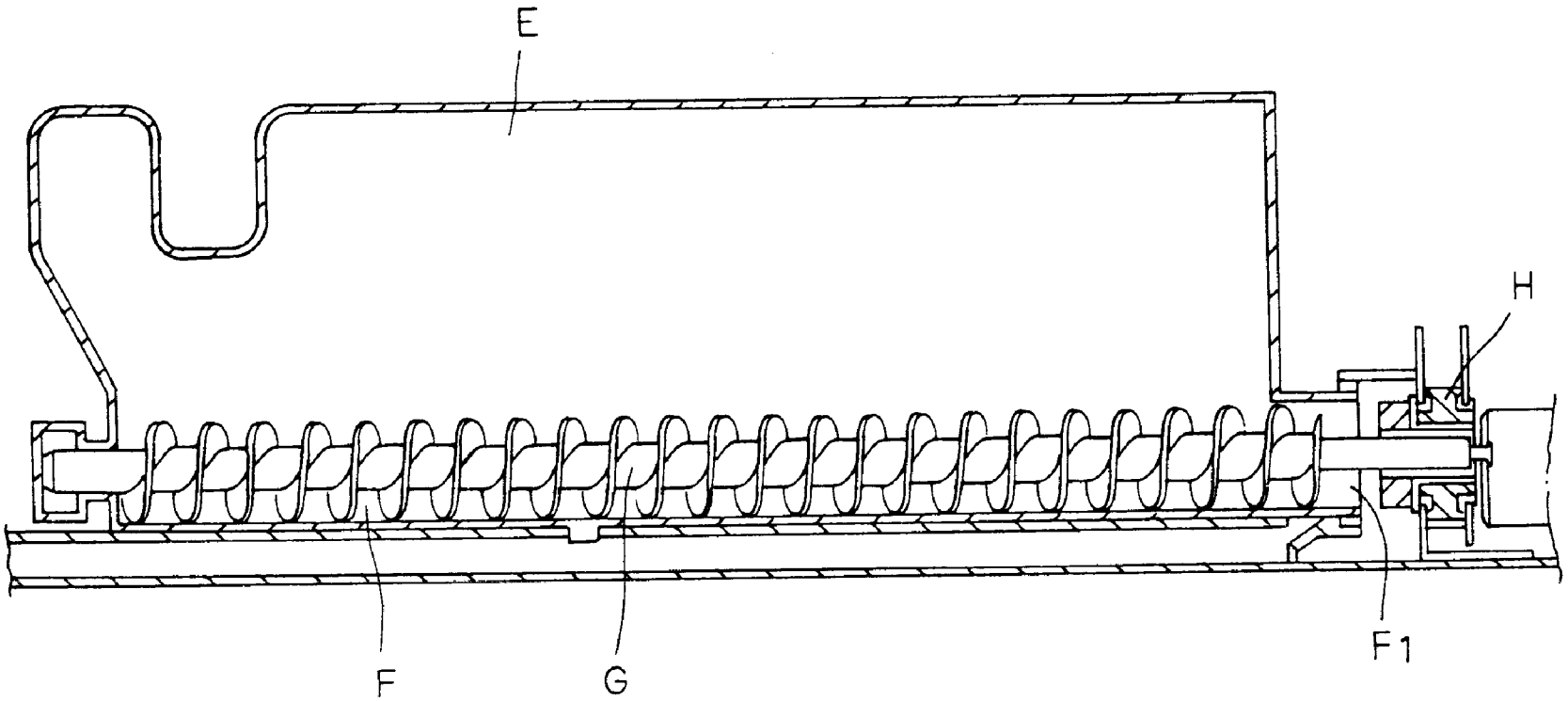
FIG. 2 (PRIOR ART)
FIG. 2 is a side view in section of a developer container according to U.S. Pat. No. 6,128,453.
Figure 3:
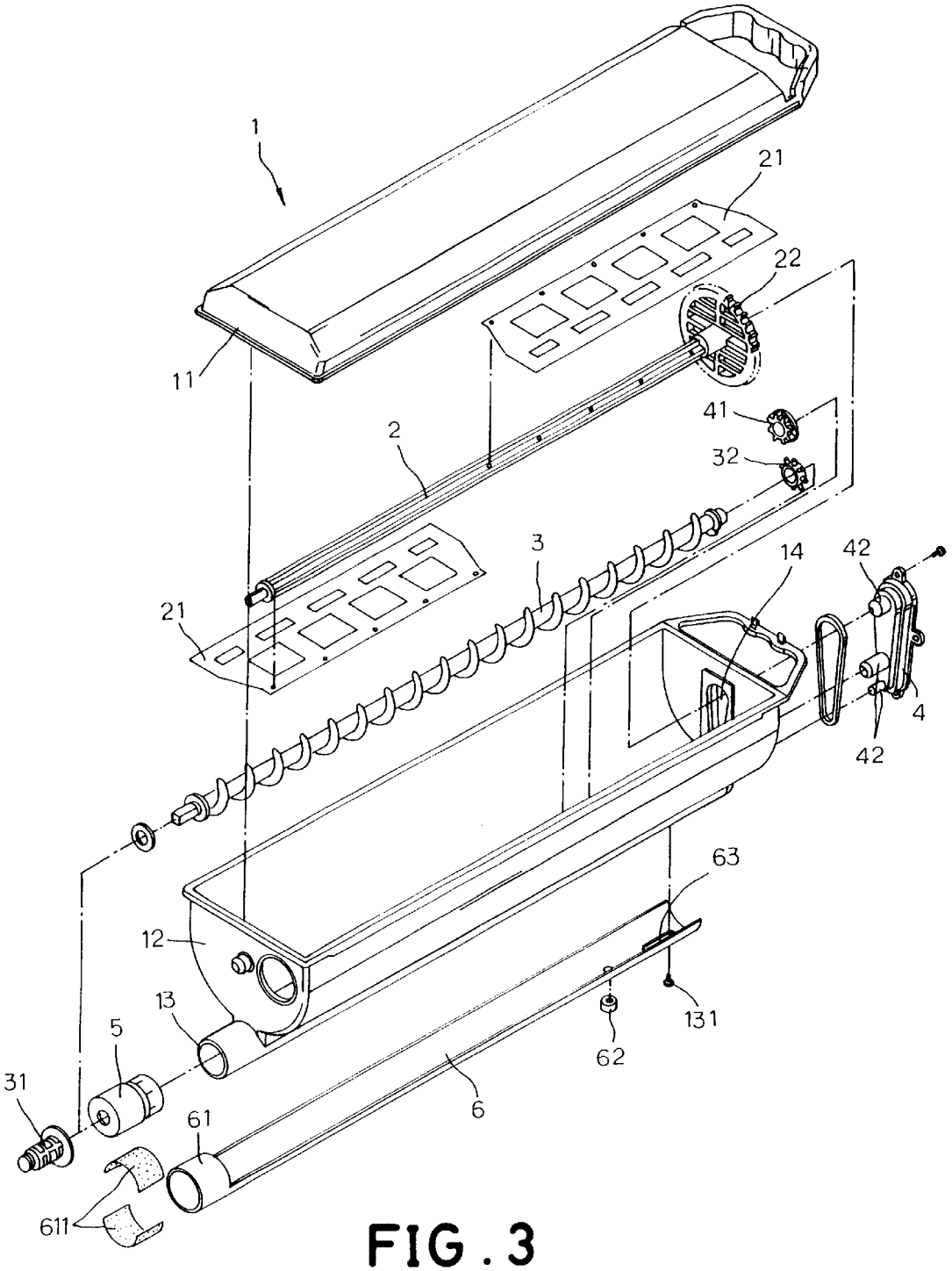
FIG. 3 is an exploded view of a developer container according to the present invention.
Figure 4:
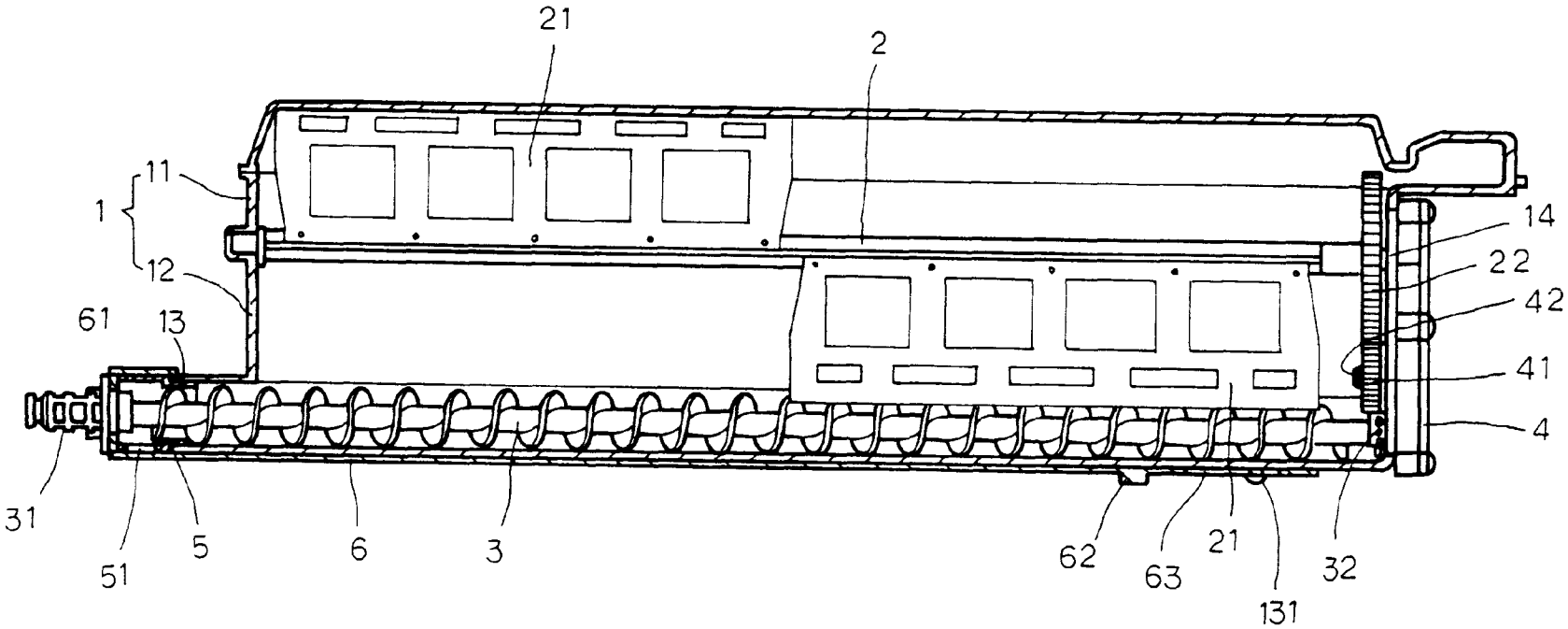
FIG. 4 is a side view in section of the present invention, showing the developer output port of the end cap closed.

Referring to FIGS. 3 and 4, a developer container is shown comprising an elongated container body 1 formed of a top container shell 11 and a bottom container shell 12, and a mixing rod 2 longitudinally pivotally mounted in the container body 1. The mixing rod 2 has two mixing blades 21 diagonally fastened to the periphery thereof at two sides, and a driven gear 22 fixedly provided at one end thereof. The bottom container shell 12 has an elongated developer supply trough 13 longitudinally disposed at the bottom side in communication with the inside holding space thereof for output of developer, and an opening 14 in one end wall thereof. A propelling screw 3 is mounted in the developer supply trough 13, and rotated to propel developer out of the developer supply trough 13. A driven member 31 is fixedly provided at one end of the propelling screw 3 and disposed outside the developer supply trough 13. An axle holder 4 is fixedly fastened to one end wall of the bottom container shell 12, having two axles 42 suspended in the opening 14 of the bottom container shell 12 at different elevations. A driving gear 32 is fixedly fastened to one end of the propelling screw 3 and supported on one axle 42 of the axle holder 4. A transmission gear 41 is supported on the other axle 42 of the axle holder 4 and meshed between the driving gear 32 and the driven gear 22.

Referring to FIGS. 3 and 4 again, after installation of the developer container in the copy machine (not shown), the connector 31 is coupled to the driving mechanism (not shown) of the copy machine. When starting the driving mechanism of the copy machine, the propelling screw 3 is rotated with the connector 31 to propel developer out of the developer supply trough 13, and at the same time the driving gear 32 is rotated with the propelling screw 3 to rotate the transmission gear 41 and then the driven gear 22, thereby causing the mixing blades 21 to be rotated with the mixing rod 2 to mix developer in the container body 1, preventing condensing of developer.

Figure 5:
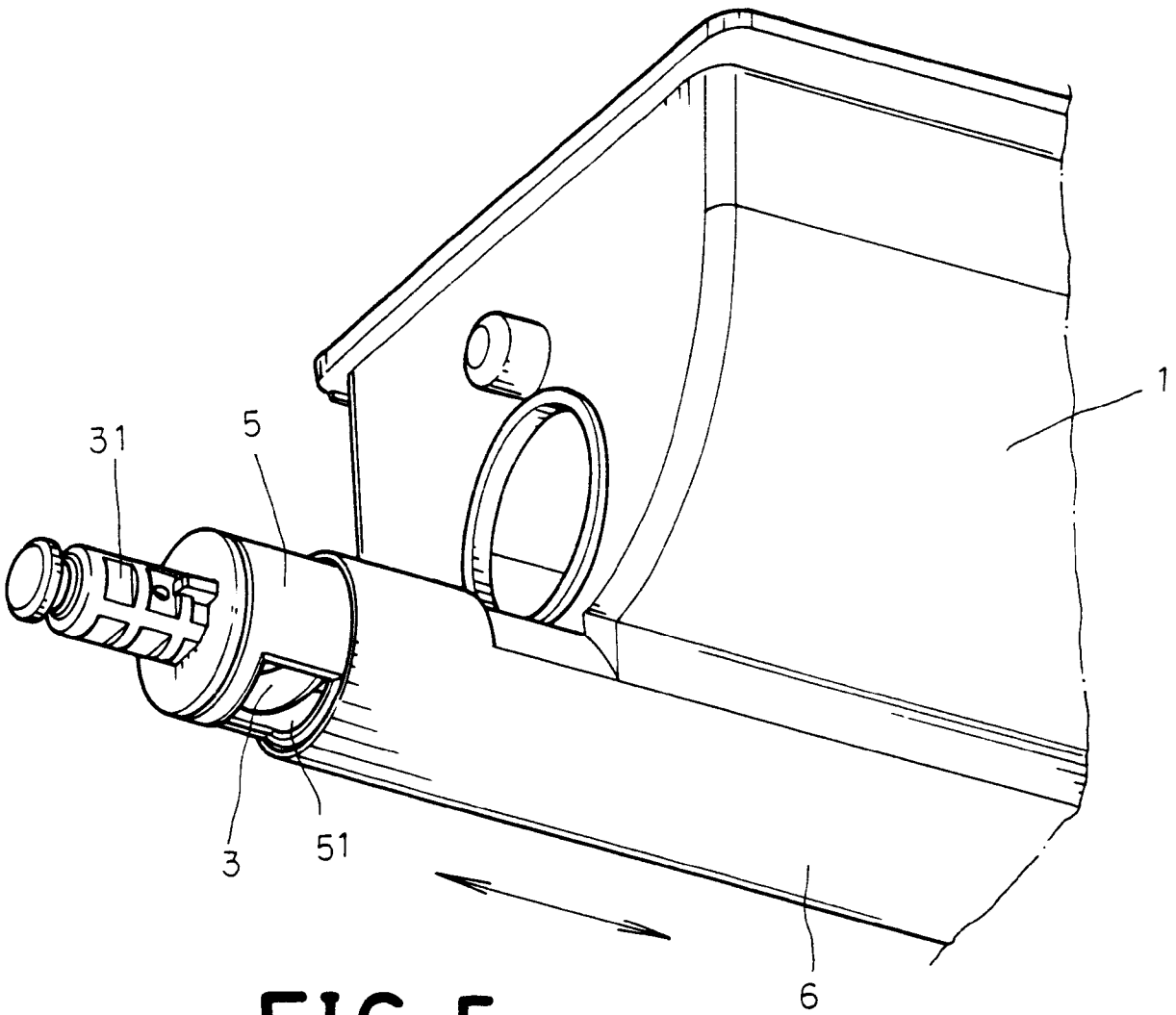
FIG. 5 is an elevational view in an enlarged scale of a part of the developer container according to the present invention.
Figure 6:
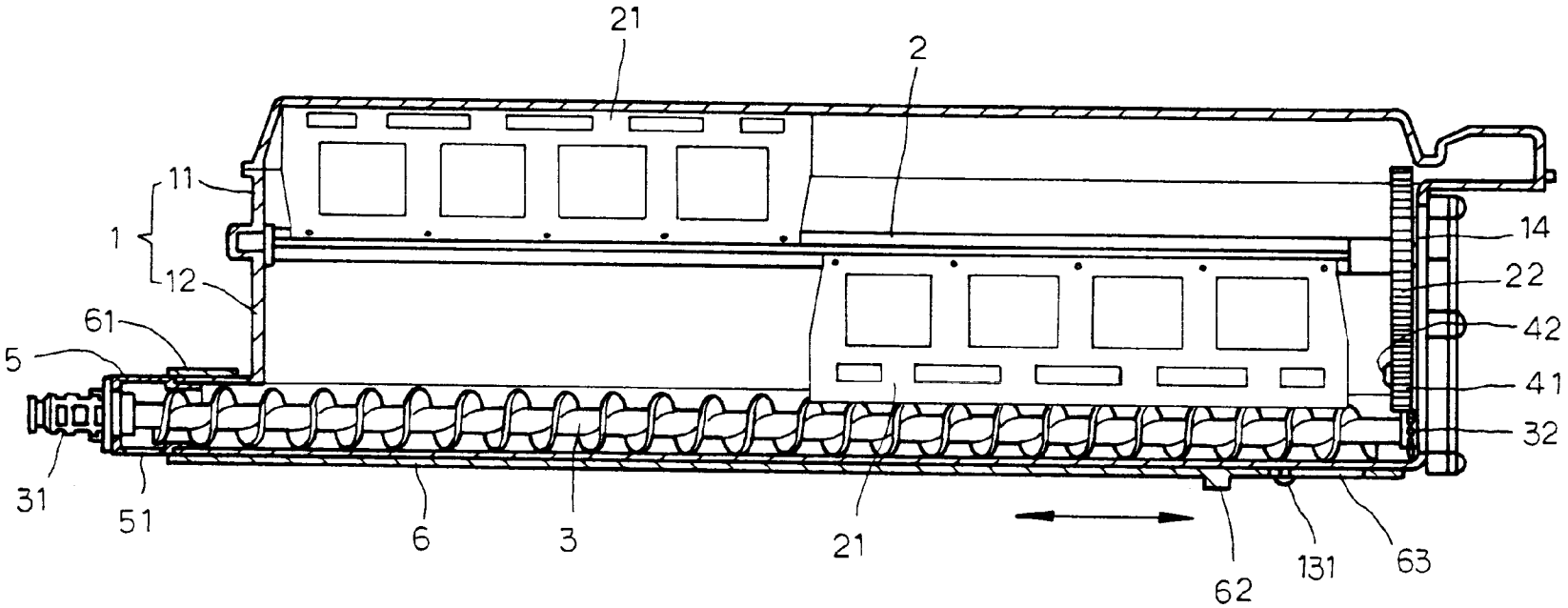
FIG. 6 is another sectional side view of the present invention, showing the developer output port of the end cap opened.

Referring to FIGS. 5 and 6 and FIG. 3 again, an end cap 5 is fastened to one end of the developer supply trough 13 to support one end of the propelling screw 3. The propelling screw 3 is axially inserted through (an axial center through hole of) the end cap 5 and then fixedly fastened to the connector 31. The end cap 5 has a developer output port 51 for output of developer from the developer supply trough 13. A slide 6 is coupled to the developer supply trough 13, and axially moved along the developer supply trough 13 to close/open the developer output port 51. The slide 6 has a barrel 61 fixedly disposed at one end and sleeved onto the end cap 5 and the protruded outer end of the developer supply trough 13, a longitudinal sliding slot 63 disposed at the other end, and a locating member 62 fixedly provided at the bottom side thereof. A guide bolt 131 is inserted through the longitudinal sliding slot 63 of the slide 6 and fixedly fastened to the outside wall of the developer supply trough 13. The guide bolt 131 guides axial movement of the slide 6 along the developer supply trough 13, preventing the slide 6 from vibration upon axial movement of the slide 6 along the developer supply trough 13. Further, linings of foamed material 611 are fixedly mounted on the inside wall of the barrel 61 in contact with the periphery of the end cap 5, and moved with the barrel 61 to close the developer output port 51 of the end cap 5.

Referring to FIGS. 5 and 6 again, after insertion of the developer container into the copy machine, the locating member 62 of the slide 6 is fastened to positioning means in the copy machine, and then the connector of the driving mechanism of the copy machine is fastened to the connector 31 and then moved to force the container body 1 forwards into the supply position. When moving the container body 1 forwards into the supply position, the end cap 5 is moved with the developer supply trough 13 relative to the slide 6, and therefore the developer output port 51 is opened. When starting the driving mechanism of the copy machine, the propelling screw 3 is rotated to propel developer out of the developer supply trough 13 through the developer output port 51 of the end cap 5, and at the same time the mixing blades 21 are rotated with the mixing rod 2 to mix developer.

A prototype of developer container has been constructed with the features of FIGS. 3~6. The developer container functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A developer container comprising an elongated container body holding a developer, a developer supply trough integral with said container body and adapted to guide developer out of said container body, a mixer mounted in said developer container and adapted to mix said developer, and a propelling screw mounted in said developer supply trough for connection to a driving mechanism of a copy machine for free rotation to propel said developer out of said developer supply trough wherein a transmission mechanism is coupled between said propelling screw and said mixer for enabling said mixer to be rotated to mix said developer in said container body upon rotary motion of said propelling screw, said transmission mechanism comprising a driving gear fastened to one end of said propelling screw, a driven gear fastened to one end of said mixer, and a transmission gear connecting said driving gear and said driven gear.

2. The developer container as claimed in claim 1 further comprising an end cap fastened to one end of said developer supply trough and supporting one end of said propelling screw in said developer supply trough, said end cap having a developer output port for output of said developer from said developer supply trough, and a slide coupled to said developer supply trough for axial movement along said developer supply trough to close and open said developer output port of said end cap.

3. The developer container as claimed in claim 1 wherein said container body has an opening in one end wall thereof, and said transmission mechanism further comprises an axle holder fastened to said opening of said container body and adapted to support said driving gear and said transmission gear respectively.

4. The developer container as claimed in claim 3 wherein said axle holder comprises two axles suspended in said opening of said container body at different elevations and adapted to support said driving gear and said transmission gear respectively.

5. The developer container as claimed in claim 2 wherein said slide comprises a barrel fixedly provided at one end thereof and sleeved onto said end cap and said developer supply trough and a longitudinal sliding slot coupled to a fixed guide bolt at a bottom side of said developer supply trough and adapted to guide axial movement of said slide along said developer supply trough.

6. The developer container as claimed in claim 5 wherein said slide further comprises at least one lining element of foamed material fixedly mounted inside said barrel.

* * * * *